US008079475B2

(12) United States Patent
McArthur et al.

(10) Patent No.: US 8,079,475 B2
(45) Date of Patent: Dec. 20, 2011

(54) BLISTER PACKAGE

(75) Inventors: Donald McArthur, Oswego, NY (US); Benjamin Davis, Columbia, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 12/011,116

(22) Filed: Jan. 24, 2008

(65) Prior Publication Data

US 2009/0188827 A1 Jul. 30, 2009

(51) Int. Cl.
*B65D 83/04* (2006.01)
*B65D 85/42* (2006.01)

(52) U.S. Cl. ..... 206/532; 206/531; 206/528; 206/538; 229/237

(58) Field of Classification Search ..... 206/528, 206/529, 531, 532, 538, 461; 229/237
See application file for complete search history.

(56) References Cited

U.S. PATENT DOCUMENTS

| | | | | |
|---|---|---|---|---|
| 3,421,615 | A | 1/1969 | Salzer et al. | |
| 3,759,371 | A * | 9/1973 | Marks | 206/531 |
| 3,872,970 | A | 3/1975 | Edison | |
| 3,942,640 | A | 3/1976 | Hellstrom | 206/469 |
| 3,948,394 | A | 4/1976 | Hellstrom | |
| 3,986,640 | A * | 10/1976 | Redmond | 222/92 |
| 4,243,144 | A | 1/1981 | Margulies | |
| 4,317,399 | A | 3/1982 | Romagnoli | |
| 4,342,395 | A | 8/1982 | Brown | |
| 4,537,312 | A * | 8/1985 | Intini | 206/531 |
| 4,911,304 | A | 3/1990 | Bunin | |
| 5,014,851 | A * | 5/1991 | Wick | 206/539 |
| 5,150,793 | A | 9/1992 | Tannenbaum | 206/531 |
| 5,310,060 | A | 5/1994 | Bitner et al. | |
| 5,339,960 | A | 8/1994 | Price | 206/531 |
| 5,360,116 | A | 11/1994 | Schmiletzky | 206/531 |
| 5,469,968 | A * | 11/1995 | Matthews et al. | 206/532 |
| 5,529,188 | A | 6/1996 | Coggswell | 206/531 |
| 5,791,478 | A * | 8/1998 | Kalvelage et al. | 206/531 |
| 5,944,191 | A | 8/1999 | Ray et al. | 206/532 |
| 6,212,858 | B1 | 4/2001 | Breitler | 53/453 |
| 6,422,391 | B1 | 7/2002 | Swartz | |
| 6,516,949 | B2 | 2/2003 | Fuller et al. | |
| 6,637,431 | B2 | 10/2003 | Ekelius et al. | 128/203.15 |
| 6,659,280 | B2 | 12/2003 | Paliotta et al. | 206/531 |
| 7,093,716 | B2 | 8/2006 | Intini | 206/532 |
| 7,188,728 | B2 | 3/2007 | Williams-Hartman | 206/532 |

(Continued)

FOREIGN PATENT DOCUMENTS

DE 44 02 038 A1 7/1995

(Continued)

*Primary Examiner* — J. Gregory Pickett
*Assistant Examiner* — Blaine Neway
(74) *Attorney, Agent, or Firm* — Flaster/Greenberg P.C.

(57) ABSTRACT

A blister package is provided for retaining individual product units. The blister package is formed by a receptacle substrate and an outer laminate. The receptacle substrate includes a sealing flange and one or more receptacle hollows for retaining product therein. The outer laminate includes a first layer covering a sealing layer, with the sealing layer bonded to the receptacle flange and covering the product within the hollows. A repeating score line pattern is formed in the outer laminate for promoting a tear in the laminate upon forcing the product from the receptacle hollow against the outer laminate. The score pattern extends substantially across the area of the outer laminate covering the receptacle hollow and includes a plurality of spaced score lines formed in a crosswise relationship.

23 Claims, 5 Drawing Sheets

U.S. PATENT DOCUMENTS

| | | | | |
|---|---|---|---|---|
| 2002/0162768 | A1 | 11/2002 | Bolnick et al. | |
| 2003/0102247 | A1 | 6/2003 | Inoue et al. | 206/532 |
| 2004/0175527 | A1 | 9/2004 | Shiota et al. | |
| 2005/0016134 | A1 | 1/2005 | Prebelli et al. | |
| 2005/0284789 | A1 | 12/2005 | Carespodi | 206/461 |
| 2007/0227932 | A1 * | 10/2007 | Bobbett et al. | 206/532 |
| 2008/0073240 | A1 * | 3/2008 | Bowers et al. | 206/532 |
| 2008/0230432 | A1 * | 9/2008 | Bobbett et al. | 206/531 |
| 2009/0145800 | A1 | 6/2009 | Bowers et al. | |

FOREIGN PATENT DOCUMENTS

| | | | |
|---|---|---|---|
| FR | 2 757 835 | | 7/1998 |
| JP | 05-161692 | | 6/1993 |
| JP | 07-149367 | | 6/1995 |
| JP | 10-323955 | | 12/1998 |
| WO | WO 2005056419 | A1 * | 6/2005 |
| WO | WO 2007/113850 | | 10/2007 |
| WO | WO 2009/143234 | | 11/2009 |
| WO | WO 2010/077797 | | 7/2010 |

* cited by examiner

BLISTER PACKAGE

FIELD OF THE INVENTION

The present invention relates to packaging and in particular blister packaging of the type used to retain product in a repeating pattern of receptacle hollows.

BACKGROUND OF THE INVENTION

Blister packages are commonly used to package ingestible products, such as candy, gum, powders, medicine tablets and the like. This type packaging is convenient for separately securing individual product portions or doses. Each individual product portion or dose may be dispensed from the package while leaving additional portions still packaged. Such blister packages may also be used for non-consumable products, such as toys, hardware, etc.

U.S. Pat. No. 5,150,793 to Tannenbaum shows a blister package having a blister sheet surrounded by a reinforcing housing made of paper. The receptacles of the blister sheet are covered by a sealing layer, which is in part formed by metallic foil. A plurality of openings are provided in registry with the blister receptacles when the package is surrounded by the paper housing. The openings align with the dimension of the blister receptacle to define an area created for forcing the item through the sealing layer.

US 2005/0284789 to Carespodi shows a push through blister package having a backing laminate with a metallic or foil layer therein. The laminate may include polymer blends as well as adhesive layers, which are affixed to the foil layer. The sealing layer is laser scored to assist in the push through dispensing of an item from the blister receptacle.

Japanese patent publications JP 05161692 and JP 07149367 appear to describe blister packages with laser slits on the sealing layer, which is made from a plastic film. The blister packages include a covering film having multiple slits formed therein, centrally positioned over a receptacle hollow.

U.S. Pat. No. 5,529,188 to Coggswell shows a blister package having a sealing layer including a plurality of crossed perforations and a plurality of perforations in a U-shaped pattern, each aligned with the receptacle.

U.S. Pat. No. 5,360,116 to Schmiletvky shows a blister package with a covering layer having a perforation pattern that surrounds the periphery of the receptacle hollow to provide a means for peeling of the covering layer away from the receptacle.

SUMMARY OF THE INVENTION

The present invention relates to a blister package for retaining individual products, such as pills, pellets, powders or the like. The blister package is formed by a receptacle substrate and an outer laminate. The receptacle substrate includes a planer sealing flange and one or more receptacle hollows formed therein for retaining product. The outer laminate is bonded to the receptacle flange and covers the product within the hollows. A repeating score line pattern is formed in the outer laminate for propagation of a tear in the laminate upon forcing a product from the receptacle hollow against the outer laminate. The score line pattern extends substantially across the area of the outer laminate covering the receptacle hollows.

In one aspect of the invention, a plurality of spaced lines that form the repeating score line pattern are formed in a crosswise relationship with respect to one another. The score lines may be straight, include curves or include various combinations thereof. Further, the score lines may vary in length throughout the pattern. The score line pattern preferably extends across the entire area of the outer laminate. Further, the outer laminate may be made from a number of layers, including a top or first layer and a sealing layer. Also, the outer laminate is preferably formed from polymer materials, such as a top layer of an oriented polyethylene film and a sealing layer compatible with the flange of the blister receptacle and the top layer.

In a further aspect of the invention the score pattern may take a number of forms. For example, the plurality of spaced score lines may be formed in an overlapping relationship, with the ends of the lines positioned in a transverse or crosswise relationship with the body portion of an adjacent line.

In a further aspect of the invention, the repeating score pattern may be defined by a plurality of rows of longitudinal score lines, the score lines in at least one of the rows being oriented in alternating crosswise angle with respect to the direction of the row. The crosswise angle of the score lines of adjacent rows may also alternate from one row to the next. Further, the ends of the score lines may be directed substantially at the body of the adjacent lines. Alternatively, or in addition thereto, the ends of the score lines in the repeating pattern may be directed substantially towards the space between adjacent score lines.

BRIEF DESCRIPTION OF THE DRAWINGS

For the purpose of illustrating the invention, there is shown in the drawings a number of forms which are presently preferred; it being understood, however, that the invention is not limited to the precise arrangements and instrumentalities shown.

DETAILED DESCRIPTION OF DRAWINGS

Figure 1:
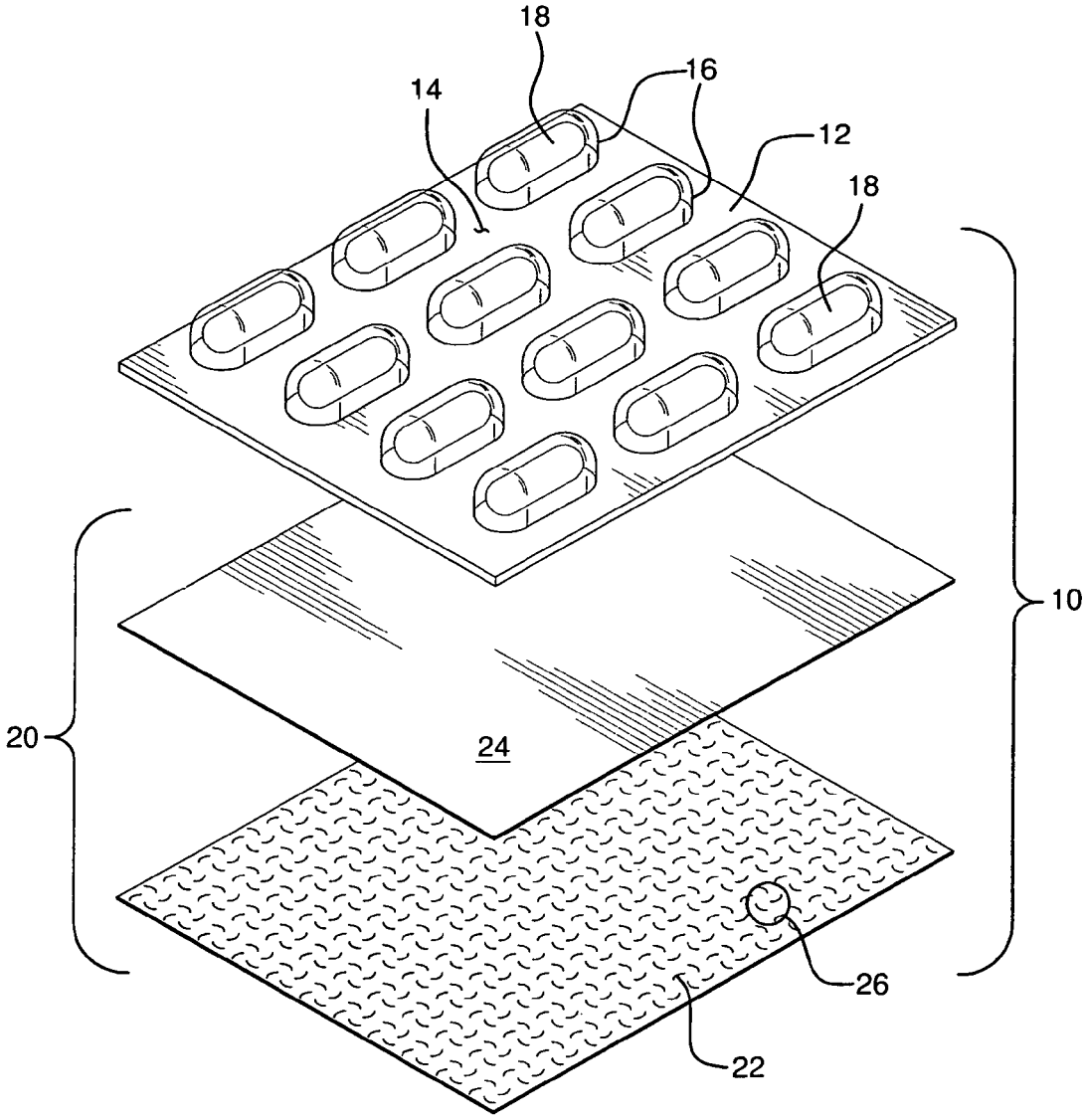
FIG. 1 is an exploded perspective view of the constituent parts of a blister package of the type contemplated by the present invention.

Referring now to the drawings, where like numerals identify like elements, there is shown in FIG. 1 a blister package which is generally referred to by the numeral 10. In FIG. 1, the blister package constituent parts include a receptacle substrate 12 formed as a sheet having a planer sealing flange 14 and a plurality of receptacle hollows 16 formed therein. Individual product units 18 are provided within each receptacle hollow 16. Each hollow 16 is separated by a portion of the sealing flange 14. A series of perforations (not shown) may be provided between adjacent receptacle hollows 16, or multiple hollows, so as to permit separation of a portion of the substrate 12 from the remainder, as desired by the user.

Figure 2:
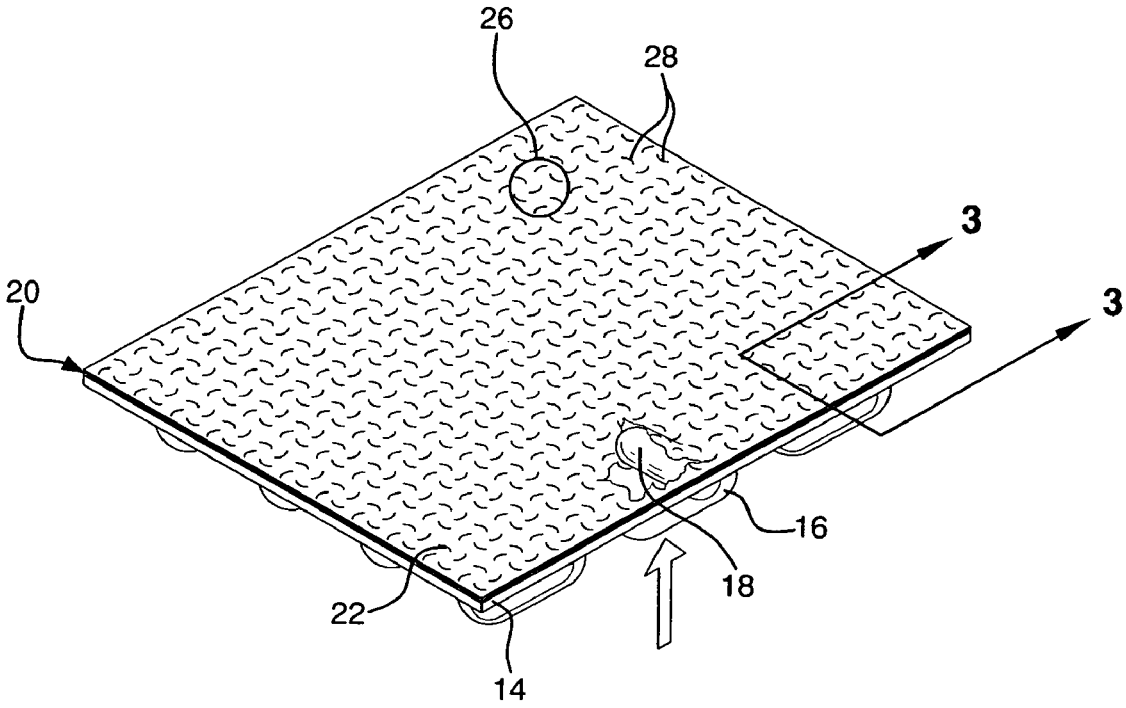
FIG. 2 is a perspective view of a blister package assembly of the type shown in FIG. 1.

An outer laminate 20 is provided adjacent the sealing flange 14 of the substrate 12. As illustrated, the outer laminate 20 includes a first or top layer 22 and a sealing layer 24 positioned between the top layer 22 and the sealing flange 14. A pattern 26 of multiple score lines 28 is provided in the top layer 22. As illustrated in FIG. 2, the score pattern 26 is continuous and extends over the entire area of the top layer 22, including across the portion of the laminate 20 covering the receptacle hollows 16.

Figure 3:
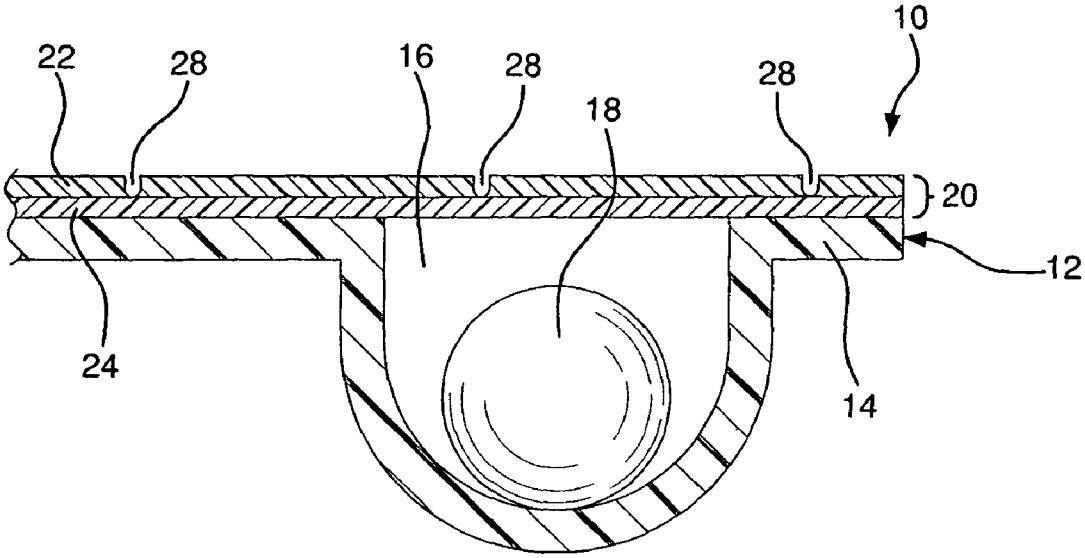
FIG. 3 is a cross sectional view of the blister package assembly of FIG. 2 as taken along lines 3-3.

In FIG. 3, the blister package 10 is shown in cross section with the sealing flange 14 covered by the outer laminate 20. The laminate 20 covers the receptacle hollow 16 and seals the product 18 therein. The sealing flange 14 of the substrate 12 is adhered to the sealing layer 24. The top layer 22 of the laminate 20 is adhered to the opposite side of the sealing layer 24. The score lines 28 forming the score pattern 26 are illustrated in cross section in FIG. 3. The score lines 28 extends into the top layer 22, but do not extend further into the sealing layer 24. The depth of the score lines 28 is subject to the needs of the manufacturer and will be based upon the desired strength of the outer laminate 20. The factors to be considered include the size of the receptacle hollow 16, the size of the product 18, the thickness of the outer laminate 20 and the materials used for the laminate 20. The score pattern 26 is intended to promote propagation of a tear in the outer laminate 20 upon forcing of the product 18 from the receptacle hollow 16 against the inside surface (sealing layer 24) of the outer laminate 20. This tearing action is illustrated in FIG. 2 by the arrow representing the force applied to the product 18 through the receptacle hollow, forcing the product 18 through the laminate 20. The score pattern 26 should not promote accidental exposure of the product 18 under normal handling conditions. The pattern 26 should, however, be extensive enough for relatively easy movement of the product 18 through the outer laminate 20 without the need for a high level of force.

The sealing layer 24, in addition to adding to the overall strength of the outer laminate 20, serves as a bonding agent for the top layer 22 to the sealing flange 14 of the receptacle substrate 12. Selection of the material for the sealing layer 24 will depend on strength requirements as well as the need to bond the receptacle substrate material to the top layer 22. Preferably, the outer laminate 20 is heat sealed to the sealing flange 14 of the receptacle substrate 12 with the sealing layer being compatible with both materials. Various forms of adhesive or mechanical means may alternatively be utilized to adhere the various layers within the structure.

Figure 4:
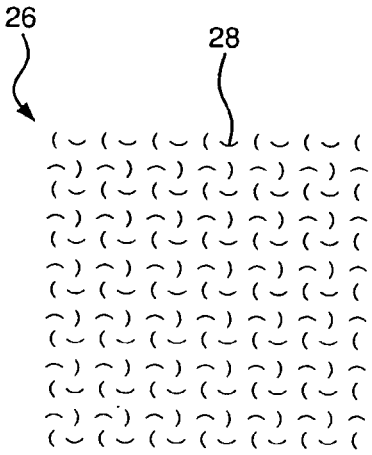
FIG. 4 is a top plan view of an example of a score line pattern for a blister package of the present invention.

In FIG. 4, the score pattern 26 is illustrated and includes having a series of curved lines 28. The curves 28 form a pattern which repeats across the surface of the top layer 22 (FIGS. 1-3). In the pattern 26 shown in FIG. 4, the curves 28 include ends which are positioned crosswise to the longitudinal body of an adjacent line. The curves 28 have an overlapping relationship, with the ends of the lines positioned transverse to the body portion of an adjacent line. The term transverse as used herein contemplates both a crosswise direction at an oblique angle or at a right angle thereto. In addition, a plurality of rows of longitudinal score lines are defined. The lines 28 in each row are oriented in an alternating angle within the row. As shown, each score line alternates between being generally perpendicular to the direction of the row and being aligned with the direction of the row. The angle of orientation of adjacent score lines also alternates from one row to an adjacent row.

Figure 5:
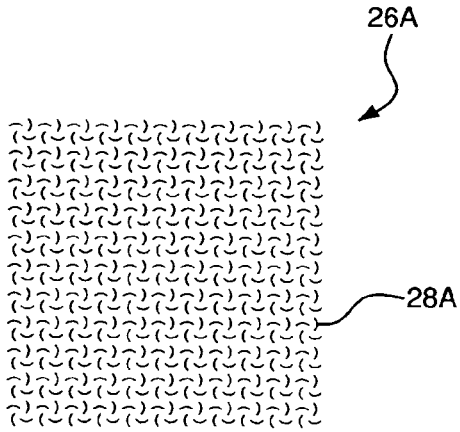
FIG. 5 is a top plan view of the score line pattern of FIG. 4 having a different score line spacing within the pattern.

In FIG. 5, the score line pattern 26A illustrated includes a series of curves 28A therein. The density of the curved lines 28A within the pattern 26A in FIG. 5 is greater than the density of the lines 28 in the score pattern 26 of FIG. 4. Otherwise, the two patterns 26 and 26A are essentially the same. The close relationship of the curves 28A, resulting in the great density of lines, effectively positions the ends of each line closer to the body portion of an adjacent line. Thus, when the space between lines is relatively smaller, under similar circumstances, it will be easier to force the product through the laminate.

Figure 6:
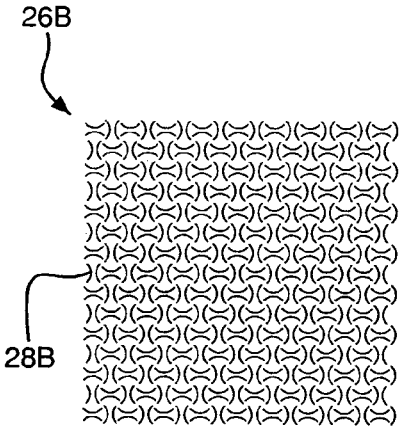
FIG. 6 is a top plan view of a further alternate example of a score line pattern for a blister package of the present invention.

In FIG. 6, the score line pattern 26B includes a series of opposing curved lines 28B. In this pattern 26B, one line 28B in the set is positioned adjacent to an opposing positioned curve. As illustrated, the opposing curves can be considered both concave and convex. The repeating pattern along a row of curve sets 28B is similar to that in FIG. 4. The curve sets 28B alternate crosswise along the row, as well as alternate from one row to an adjacent row.

Figure 7:
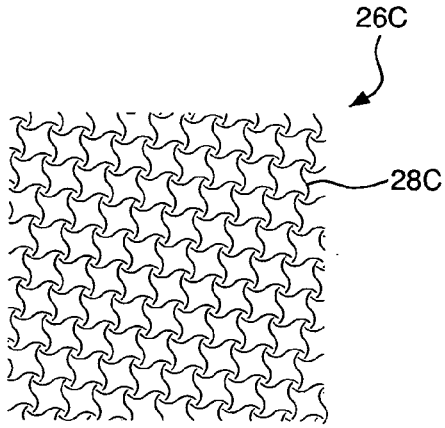
FIG. 7 is a top plan view of a still further alternate example of a score line pattern for a blister package of the present invention.

In FIG. 7, the score line pattern 26C includes a series of "S" curve lines 28C, with the ends of the curves being positioned adjacent one another in an overlapping pattern. The adjacent ends of the curves 28C form a box therebetween with the body of the adjacent lines forming a larger box. A space is contemplated to be provided between the ends of the curves, similar to the patterns previously described herein. The position of the ends of the curves 28C and the body portion of the curves vary as desired for the promotion of a tear in the laminate, upon forcing the product from the receptacle hollow against the outer layer.

Figure 8:
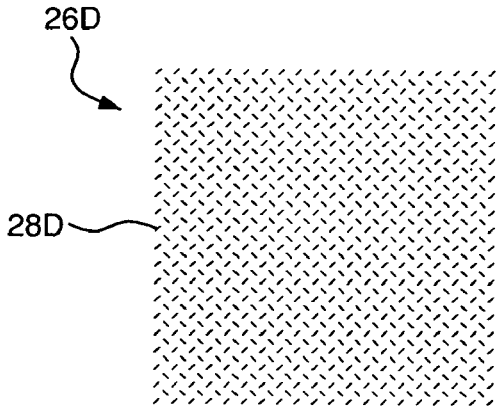
FIG. 8 is a top plan view of another example of a score line pattern for a blister package of the present invention.

In FIG. 8, a score pattern 26D includes a series of straight lines 28D positioned perpendicular to one another. The score lines 28D have an overlapping relationship, similar to the curved line patterns as discussed previously. The score lines 28D are positioned in a plurality of angled rows, with each line in the row oriented at the same angle with respect to the direction of the row. In this pattern 26D, there are also vertical and horizontal rows, wherein the lines alternate in direction. The crosswise angle of the score lines 28D also alternate from one row to an adjacent row.

Figure 9:
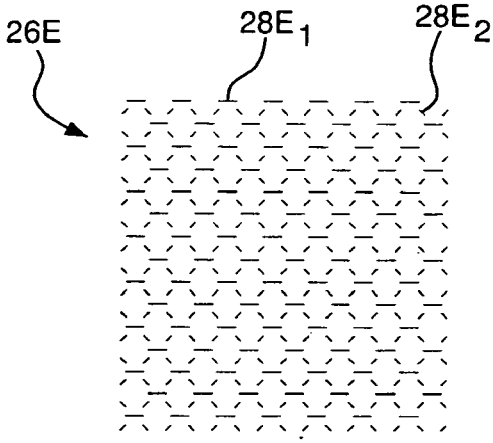
FIG. 9 is a top plan view of still another example of a score line pattern for a blister package of the present invention.

In FIG. 9, the score pattern 26E includes a series of lines 28$E_1$ and 28$E_2$. A first row of score lines 28$E_1$ includes a series of aligned dashes. The adjacent row of score lines 28$E_2$ include slanting lines, which alternate in their angle of slant. The ends of the lines 28$E_2$ in the second row are directed towards the central portion of the lines 28$E_1$, the dashed row. The score pattern 26E includes a plurality of spaced score lines forming a repeating pattern, with the ends of the lines in one row positioned in a crosswise direction to the body of the line in an adjacent row. The lines 28$E_2$ are at an oblique angle with respect to the lines 28$E_1$. The transverse angle of the score lines 28$E_1$, 28$E_2$ may vary as desired.

Figure 10:
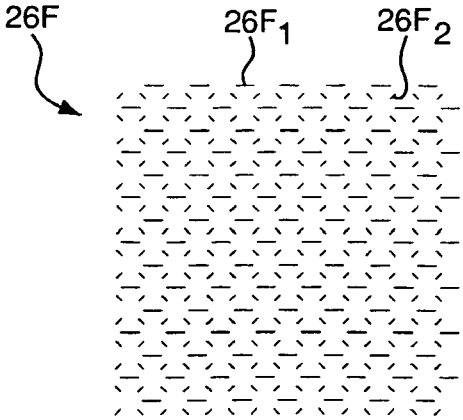
FIG. 10 is a top plan view of a further example of a score line pattern for a blister package of the present invention.

In FIG. 10, the score pattern 26F is similar to that in FIG. 9 excepting that the slanting lines 26$F_2$ in the second row are directed toward the spaces between the adjacent dash lines 26$F_1$. Thus, the score pattern 26F has repeating score lines forming an overlapping relationship, with the ends of the lines directed towards a space between the lines in an adjacent row. The transverse lines 28$F_2$ are at an oblique angle with respect to the adjacent lines 28$F_1$. The score lines 28$F_2$ in at least one row are oriented in an alternating crosswise angle with respect to the direction of the row. In addition, the crosswise angle of the score lines 28$F_2$ in one row is also transverse to the direction of the lines 28$F_1$ in the adjacent row.

The score line patterns as contemplated by the present invention may be incorporated into the outer laminate by any number of known methods, including laser absorption, die cutting, heat scoring or the like. Preferably, a rotary die cutting process is utilized, so as to mechanically control the depth of cut into the outer layer. Depth of cut is one option in controlling the effectiveness of the score pattern, while at the same time maintaining the package integrity under normal handling conditions. As illustrated in FIG. 3, the depth of cut is preferably part of the way through the laminate structure. In the preferred embodiment, the outer layer is formed as a laminate with two separate materials being provided. Numerous variations on this structure are contemplated, including a single layer of material forming the outer layer or multiple layers within a laminate. It is contemplated that the scoring may be at any depth into the outer layer. In addition, coatings or printing may be added within the laminate layers, as desired. It is preferred that a foil material not be utilized, due to cost and handling considerations. By controlling the depth of the score pattern and the position of the score lines, the blister package will maintain package integrity while also providing ease of dispensing through the outer layer.

In the drawings and specification, there has been set forth a number of embodiments of the invention and, although specific terms are employed, these terms are used in a generic and descriptive sense only and not for purposes of limitation. The scope of the invention is set forth in the following claims.

What is claimed is:

1. A blister package for retaining individual products, the package comprising:

an outer laminate, and a receptacle substrate, the receptacle substrate having a planer sealing flange and at least one retaining receptacle hollow formed to retain product therein, the outer laminate comprising a first layer having a score pattern thereon for promoting propagation of a tear in the outer laminate upon forcing the product from the receptacle hollow against the outer laminate, and a sealing layer positioned between the first layer and the receptacle substrate, the sealing layer bonded on one side to the receptacle substrate flange and covering the receptacle hollow, and the sealing layer bonded to the first layer on the opposite side of the sealing layer from the flange substrate and receptacle hollow, and wherein the score pattern extends substantially across the portion of the outer laminate covering the receptacle hollow of the receptacle substrate, the score pattern having a plurality of spaced curved score lines forming a repeating pattern with the ends of each of the score lines positioned in a crosswise direction to the body of an adjacent line, and wherein the score pattern is defined by a plurality of aligned rows with the score lines within each of the rows having an alternating pattern, such that each score line is oriented in an alternating crosswise angle with respect to the direction of each adjacent score line in the row.

2. A blister package as in claim 1 wherein the score pattern extends across the entire area of the outer laminate.

3. A blister package as in claim 1 wherein the score pattern is formed only in the first layer.

4. A blister package as in claim 1 wherein the outer laminate is formed from polymer materials.

5. A blister package as in claim 1 wherein the first layer is an oriented polyethylene film.

6. A blister package as in claim 1 wherein the sealing layer is heat sealed to the flange of the receptacle substrate.

7. A blister package for retaining individual products, the package comprising:

a receptacle substrate, an outer layer, the receptacle substrate having a sealing flange and at least one retaining receptacle hollow formed therein, the hollow formed for retaining one or more products therein, the outer layer formed from polymer film and bonded to the sealing flange and covering the receptacle hollow, and a repeating score line pattern extending substantially across the area of the outer layer covering the receptacle hollows, the score lines in the pattern extending into the outer layer at a depth less than the thickness of the layer, the repeating pattern having a plurality of spaced score lines formed to promote propagation of a tear in the outer layer upon forcing a product within the receptacle hollow against the outer layer, wherein the repeating pattern is defined by a plurality of rows of curved score lines, the curved score lines in each row being oriented in an alternating crosswise angle with respect to the direction of orientation of each adjacent curved score line in the row.

8. A blister package as in claim 7, wherein the outer layer is formed by a laminate material having a plurality of material layers.

9. A blister package as in claim 8, wherein the material layers of the outer layer laminate comprise a first layer having the score line pattern therein and a second layer for forming a seal between first layer and the sealing flange of the receptacle substrate.

10. A blister package as in claim 9, wherein the first layer is an oriented polyethylene film.

11. A blister package as in claim 9 wherein the second layer is heat sealed to the flange of the receptacle substrate.

12. A blister package as in claim 7 wherein at least one end of each score line is directed substantially towards the body of at least one adjacent score line.

13. A blister package as in claim 7 wherein the score lines in each of an adjacent pair of rows are oriented in alternating crosswise angles with respect to the adjacent score lines in the adjacent row.

14. A blister package as in claim 1 wherein the score lines within each of the adjacent aligned rows are oriented in alternating crosswise angle with respect to the direction of the score lines in each of the adjacent aligned rows.

15. A blister package as in claim 1 wherein the curved score lines within each of the plurality of rows include a pattern of pair-sets of curved lines.

16. A blister package as in claim 15 wherein the pair-sets of curved lines comprise opposing curves.

17. A blister package as in claim 1 wherein the curved lines are "S" shaped.

18. A blister package as in claim 17 wherein the ends of the adjacent curved lines are positioned adjacent and in an overlapping relationship.

19. A blister package for retaining individual products, the package comprising:

a receptacle substrate, the receptacle substrate having a planer sealing flange and at least one retaining receptacle hollow formed to retain product therein, and a top layer covering the receptacle hollow in the receptacle substrate, at least a portion of the top layer formed from a polymer film, the top layer having a score pattern thereon for promoting propagation of a tear therein upon forcing the product from the receptacle hollow against the portion of the top layer covering the receptacle substrate, and a portion of the top layer overlapping and sealed to the planer sealing flange, and wherein the score pattern extends substantially across the portion of the top layer covering the receptacle hollow, the score pattern having a plurality of spaced curved score lines forming a repeating pattern with the ends of the score lines positioned in a crosswise direction to the body of each adjacent line, and wherein the score pattern is defined by a plurality of aligned rows with the score lines within each of the rows having an alternating pattern, such that each score line is oriented in an alternating crosswise angle with respect to the adjacent score line in an adjacent row.

20. A blister package as in claim 19 wherein the top layer is an oriented polyethylene film.

21. A blister package as in claim 1 wherein the sealing layer is heat sealed to the sealing flange of the receptacle substrate.

22. A blister package for retaining individual products, the package comprising:

a receptacle substrate, the receptacle substrate having a planer sealing flange and at least one retaining receptacle hollow formed to retain product therein, and a top layer covering the receptacle hollow in the receptacle substrate, at least a portion of the top layer formed from a polymer film and having a portion of the top layer overlapping and sealed to the planer sealing flange, and a repeating pattern of spaced score lines formed in the top layer for promoting propagation of a tear in the top layer upon forcing a product from the at least one retaining receptacle hollow against the top layer, the score pattern extending substantially across the portion of the top layer covering the at least one retaining receptacle hollow, the repeating score pattern defined by a plurality of rows of curved score lines, the score lines within each of the rows having an alternating pattern, and the score lines in the alternating pattern are positioned at opposing angles with respect to each of the adjacent score lines in the row.

23. A blister package as in claim 22 wherein the top layer further comprising a sealing layer, the sealing layer being heat sealed to the sealing flange of the receptacle substrate.

* * * * *